US005299479A

United States Patent [19]

Wallmann et al.

[11] Patent Number: 5,299,479

[45] Date of Patent: Apr. 5, 1994

[54] METHOD AND APPARATUS FOR PROVIDING EDGE-SIDE TRACKS OF HOLES AT A PRINTING BELT FOR ROTARY PRINTING MACHINES

[75] Inventors: Wilfried Wallmann, Lengerich; Günter Rogge, Lienen, both of Fed. Rep. of Germany

[73] Assignee: Windmoller & Holscher, Lengerich, Fed. Rep. of Germany

[21] Appl. No.: 712,755

[22] Filed: Jun. 10, 1991

[30] Foreign Application Priority Data

Jun. 8, 1990 [DE] Fed. Rep. of Germany ..... 4018467

[51] Int. Cl.[5] ..... B26F 1/12

[52] U.S. Cl. ..... 83/18; 83/660; 83/560; 83/867; 83/175

[58] Field of Search ..... 83/18, 33, 30, 660, 83/423, 559, 560, 678, 866, 867, 318, 175, 278, 214, 276, 331, 332

[56] References Cited

U.S. PATENT DOCUMENTS

| | | | |
|---|---|---|---|
| 1,958,694 | 5/1934 | Chandler | 83/660 |
| 2,854,077 | 9/1958 | Novak et al. | 83/318 |
| 3,640,481 | 2/1972 | Pugh | 83/214 |
| 3,718,059 | 2/1973 | Clayton | 83/867 |
| 3,735,660 | 5/1973 | Pearl | 83/560 |
| 3,916,744 | 11/1975 | West | 83/175 |
| 3,992,966 | 11/1976 | D'Agostino | 83/175 |
| 4,098,159 | 7/1978 | Rothfuss | 83/660 |
| 4,635,316 | 1/1987 | Towne et al. | 83/678 |
| 4,747,895 | 5/1988 | Wallerstein et al. | 83/660 |
| 4,928,562 | 5/1990 | Tanimura et al. | 83/278 |

FOREIGN PATENT DOCUMENTS

| | | |
|---|---|---|
| 444987 | 5/1927 | Fed. Rep. of Germany . |
| 2353226 | 5/1975 | Fed. Rep. of Germany . |
| 8122637 | 7/1982 | Fed. Rep. of Germany . |

*Primary Examiner*—Richard K. Seidel
*Assistant Examiner*—Allan M. Schrock
*Attorney, Agent, or Firm*—Keck, Mahin & Cate

[57] ABSTRACT

A method for providing edge-side tracks of holes in a printing belt for a rotary printing machine with at least one counter pressure cylinder and at least two printing belt cylinders around which the continuous printing belt carrying printing forms or printing pictures is led, with one printing belt cylinder being provided with radial ring of pins in the region of each of its ends, wherein the pins mesh with holes of the edge-side tracks of holes of the printing belt. The printing belt is stretched with a tension corresponding to the tension with which the printing belt is led around the printing belt cylinders in printing operation. Said state of tension is maintained during the punching of the tracks of holes such that the punched holes maintain their circular shape even in the stretched state of the printing belt in a printing machine and that the distance of the spacing of the holes of the tracks of holes exactly corresponds to the spacing of the pins of the radial rings of pins. A machine frame for carrying out the method includes a clamp for holding the front end of the belt, stretching rollers for stretching the belt, a supply roller for feeding belt between stretching wheels, an upper shaft carrying a punch wheel at each end and a lower shaft carrying a die wheel at each end, sledge-like carriages mounted in tracks at each side of the frame to carry the punch and die wheels along the side-edge of the belt to punch the tracks of holes.

6 Claims, 1 Drawing Sheet

METHOD AND APPARATUS FOR PROVIDING EDGE-SIDE TRACKS OF HOLES AT A PRINTING BELT FOR ROTARY PRINTING MACHINES

BACKGROUND OF THE INVENTION

This invention relates to a method for providing edge-side tracks of holes at a printing belt for a rotary printing machine with at least one counter pressure cylinder and at least two printing belt cylinders around which a continuous printing belt carrying printing forms or printing pictures is led, with at least one such cylinder being provided with a radial ring of pins in the region of each of its ends, wherein pins mesh with holes of the edge-side tracks of holes of the printing belt for slip-free guiding of the belt, and also relates to an apparatus for carrying out said method.

Rotary printing machines of said kinds which are provided with continuous printing belts, by which the format length can be increased independent of the diameters of the printing belt cylinders, which form idler rollers, are known for instance from the German Utility Model G 81 22 637.3 and the German Patent 444,987.

For the preparation of a print, printing belt sections, which can e.g. be belts made of polyester film, at their side edges are provided with the tracks of holes by punching. The printing belt is then put around the printing belt cylinders such that the holes of the edge-side tracks of holes mesh with the pins of the radial rings of pins of the printing cylinder. The ends of the printing belt section are connected with each other so that the continuous printing belt is obtained. For the connection of the ends of a printing belt section they can be provided with tooth rows being undercut in a dovetailed form, which can be brought into a positive engagement with each other. The engagement of the two tooth rows can then be secured by adhesive tapes glued thereto. The printing belts carry in a usual manner the blocks which can be glued thereto.

The continuous printing belt being led in a printing machine over the printing belt cylinders is subject to a certain tension so that it is elastically stretched. Said elastic stretching has the effect that the circular holes of the edge-side perforations, punched in the slack printing belt, are ovally or elliptically deformed in longitudinal direction of the printing belt, so that between the pins of the pin rings and the holes of the edge-side perforations a backlash is obtained and a slip-free guidance of the printing belt on the printing belt cylinder is no longer guaranteed. Said backlash resulting from the elliptical deformation of the holes can lead to a blurring of the printing image. Moreover, due to a stretching of the printing belt, the spacing of the holes of the edge-side perforations no longer corresponds to the spacing of the pins of the radial pin rings so that troubles can also occur in this respect.

SUMMARY OF THE INVENTION

It is the object of the invention to provide a method of the kind mentioned hereinbefore, according to which the edge-side perforations can be provided in a printing belt in such a manner that the punched holes maintain their circular shape even in the stretched state of the printing belt in a printing machine and that the distance of the spacing of the holes of the tracks of holes exactly corresponds to the spacing of the pins of the radial pin rings.

According to the invention, prior to providing the edge-side tracks of holes, the printing belt is stretched with a tension corresponding to the tension with which the printing belt is led around the printing belt cylinders in printing operation. According to the inventive method, the holes constituting the edge-side perforations are punched in a printing belt which is stretched during punching with a tension corresponding to the state of tension of the printing belt in the printing machine. In the printing belt tensioned in this way, circular holes with the correct hole spacing can be punched.

An apparatus for carrying out the method according to the invention includes, at one end of a machine frame, holding means for one end of the printing belt, and at the opposite end of the frame, stretching means for the other end of the printing belt are provided. At the sides of the machine frame, tracks for punching means which can be moved in parallel to the side edges of the printing belt clamped in the frame are arranged. In the apparatus according to the invention, a belt section of the printing belt can be stretched with the same tension to which the printing belt is subject in the printing machine later on so that circular holes with a correct spacing distance can be punched.

The stretching means can consist of a pair of stretching rollers in the roller gap of which the printing belt can be fixedly clamped. Also the pair of rollers can constitute the holding means, and for the application of the tension, the stretching means may be arranged in a carriage which can be moved for stretching the belt section. It is, however, easier to apply the tension via the pair of stretching rollers since the belt can be easily stretched by a drive with a torque producing the desired state of tension.

Advantageously, a supply roller is arranged preceding the pair of stretching rollers. The pair of stretching rollers can also be operated as a pair of transport rollers so that therethrough the required length of belt section can be drawn off the supply roller.

In a further development of the invention it is provided that the punching means consist of a punch wheel with clipping punches arranged radially at its circumference and a synchronously driven die wheel with cutting holes cooperating with the clipping punches. A punching means of said kinds, consisting of punch wheels and die wheels, is for instance known from the German laid-open print 23 53 226.

According to a particularly advantageous development of the invention it is provided that for the perforation of the two edge-side tracks of the printing belt the punch wheels and die wheels are mounted on common shafts carried in sledge-like carriages. For the perforation of the correspondingly pre-tensioned belt, the sledge-like carriages then only have to be moved along a correspondingly long belt section. The carriage itself is provided with an advance drive corresponding to the passing speed of the web to be punched by the punches and die wheels of the punching means.

An embodiment of the invention will now be described in the following with reference to the drawing.

DETAILED DESCRIPTION OF PREFERRED EMBODIMENTS

Figures 1, 2:
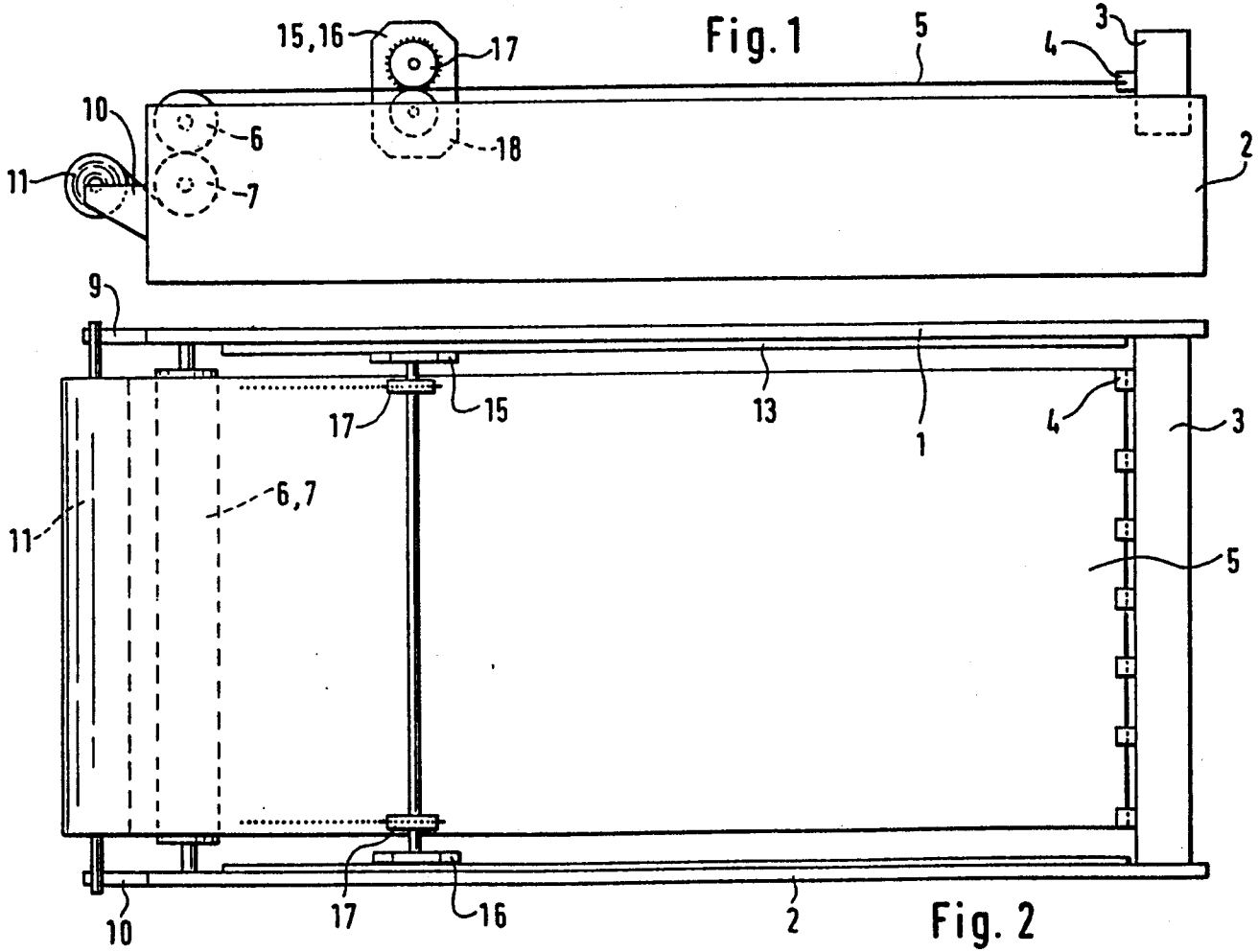
FIG. 1 shows a schematic side view of the punching means.
FIG. 2 is a top plan view of the punching means according to FIG. 1.

The punching means is arranged in a machine frame consisting of the side parts 1, 2 and cross bars 3 connecting them. At the front end of the frame at cross bar 3 there is provided a row of holding means 4 consisting of upper and lower clamping jaws which can be opened and closed and can clamp the front edge of the printing belt 5 which is to be provided with edge-side perforations in the represented manner. In the rear end portion of the punching means, between the side parts 1, 2, a pair of clamping rollers is carried which consists of rollers 6, 7. The rollers 6, 7 are provided with a drive (not shown) via which the belt section being clamped between the clamping rollers and the holding means 4 can be stretched in a predetermined manner.

At the rear end of the frame the consoles 9, 10 are attached in which the shaft of a supply roller 11 with the printing belt is carried in a usual manner.

At their inner sides, the side frames are provided with tracks 13, 14 for carriages 15, 16 movable thereon in which shafts are carried on which the upper punch wheels 17 and the lower die wheels 18 of rotation punching means are carried. The shafts are provided with drives (not shown). Furthermore, the carriages 15, 16 are movable by advance means (not shown).

We claim:

1. Method for providing tracks of holes at side edges of a printing belt for a rotary printing machine which has at least one counter pressure cylinder and at least two printing belt cylinders around which the printing belt is to be led, with one cylinder thereof being provided with a radial ring of pins in the regions of each of its ends, to mesh with the holes of the printing belt, the method comprising:

elastically stretching the printing belt to a predetermined tension substantially equal to the tension with which the printing belt is to be led around the printing belt cylinders in printing operations, maintaining said state of tension, and punching tracks of circular holes in the tensioned belt spaced corresponding to the spacing of the radial ring of pins on the printing belt cylinders at the tension of the belt during printing.

2. Apparatus for providing tracks of holes at side edges of a printing belt for a rotary printing machine which has at least one counter pressure cylinder and at least two printing belt cylinders around which the printing belt is to be led, with one cylinder thereof being provided with a radial ring of pins in the regions of reach of its ends, to mesh with the holes of the printing belt, the apparatus comprising a machine frame with holding means at one end of the frame for clamping one end of the printing belt and stretching means at an opposite end of the frame for elastically stretching the belt to a predetermined tension, elongate tracks extending along opposite sides of the frame and punching means movably mounted on said tracks for movement parallel to side edges of a printing belt clamped in the frame for punching spaced circular holes along the side edges of the belt whereby the circular holes punched in the stretched printing belt are spaced at a distance substantially equal to the spacing of the radial ring of pins on the printing belt cylinders at the tension of the belt during printing.

3. Apparatus according to claim 2, wherein the stretching means includes a pair or stretching rollers having a roller gap in which the printing belt can be clamped.

4. Apparatus according to claim 2 including a supply roller for feeding said belt through the pair of stretching rollers.

5. Apparatus according to claim 2 wherein the punching means includes a punch wheel with clipping punches arranged radially at its circumference and a die wheel with cutting holes for cooperation with the clipping punches.

6. Apparatus according to claim 5, wherein punching means includes a pair of punch wheels mounted on a common shaft and a pair of die wheels mounted on a common shaft, wherein said shafts are carried in sledge-like carriages for punching such edge-side tracks of holes.

* * * * *